United States Patent [19]

Whitehead

[11] Patent Number: 4,981,838

[45] Date of Patent: Jan. 1, 1991

[54] SUPERCONDUCTING ALTERNATING WINDING CAPACITOR ELECTROMAGNETIC RESONATOR

[75] Inventor: Lorne A. Whitehead, Vancouver, Canada

[73] Assignee: The University of British Columbia, Vancouver, Canada

[21] Appl. No.: 309,337

[22] Filed: Feb. 10, 1989

Related U.S. Application Data

[63] Continuation-in-part of Ser. No. 169,293, Mar. 17, 1988, abandoned.

[51] Int. Cl.[5] ..... H01P 7/08

[52] U.S. Cl. ..... 505/1; 505/701; 505/705; 505/866; 333/219; 333/185; 333/995

[58] Field of Search ..... 333/175, 177, 185, 219, 333/219.2, 995; 334/41; 343/895; 336/DIG. 1, 200, 232; 505/1, 866, 701, 705

[56] References Cited

U.S. PATENT DOCUMENTS

| | | | |
|---|---|---|---|
| 2,584,592 | 2/1952 | Kehbel | 336/232 |
| 3,247,476 | 4/1966 | Pintell | 336/177 |
| 3,656,168 | 4/1972 | Stropki | 343/895 |
| 4,048,593 | 9/1977 | Zillman | 333/185 X |
| 4,310,821 | 1/1982 | Frances | 336/200 |
| 4,369,557 | 1/1983 | Vandebult | 29/25.42 |
| 4,494,100 | 1/1985 | Stengel et al. | 336/200 |
| 4,525,720 | 6/1985 | Corzine et al. | 343/895 |
| 4,578,654 | 3/1986 | Tait | 333/175 |
| 4,598,276 | 7/1986 | Tait | 340/572 |
| 4,614,925 | 9/1986 | Kane | 333/174 |
| 4,638,270 | 1/1987 | Machamer | 333/175 |
| 4,754,242 | 6/1988 | Okamura et al. | 333/175 |

FOREIGN PATENT DOCUMENTS

| | | | |
|---|---|---|---|
| 1177884 | 9/1985 | U.S.S.R. | 333/176 |

OTHER PUBLICATIONS

Remke, et al; "Spiral Inductor for Hybrid & Microwave Applications"; *Patent Associated Literature;* 24th Electronic Components Conf., Wash. D.C.; 13–15, May 1974, pp. 152–161.

*Primary Examiner*—Benny T. Lee
*Attorney, Agent, or Firm*—Barringer & Oyen

[57] ABSTRACT

An electromagnetic resonator has two or more non-intersecting, substantially overlapping surfaces of approximately similar size and shape separated from one another by a distance which is small in comparison to the physical extent of the surfaces. One or more substantially non-intersecting, electrically conductive paths cover substantial portions of each surface. The widths of the paths are substantially smaller than the physical extent of the surfaces. No path on any one of the surfaces is electrically connected to a path on any of the other surfaces. The conductive paths are oriented such that, for each of the surfaces, macroscopic current flows, with respect to the surfaces, in a direction other than the direction in which microscopic current flows in the paths. The paths are also oriented such that the resonator supports at least one mode of electromagnetic oscilaltion between a first state in which the electromagnetic energy stored by the resonator is substantially electrostatic energy, and a second state in which the electromagnetic energy stored by the resonator is substantially magnetostatic energy; the frequency of the oscillations being substantially lower than any characteristic self-resonant frequency of electromagnetic oscillation of any one of the paths, taken alone.

26 Claims, 5 Drawing Sheets

SUPERCONDUCTING ALTERNATING WINDING CAPACITOR ELECTROMAGNETIC RESONATOR

REFERENCE TO RELATED APPLICATION

This is a continuation-in-part of U.S. application Ser. No. 169,293 filed Mar. 17, 1988, now abandoned.

FIELD OF THE INVENTION

This application pertains to electromagnetic resonators having a high quality factor "Q" at comparatively low frequencies.

BACKGROUND OF THE INVENTION

The quality factor "Q" which characterizes the relative damping of an electromagnetic resonator operating at its resonant frequency is directly proportional to the energy stored by the resonator and inversely proportional to the average power dissipated in resistive components of the resonator. The energy stored by the resonator is in turn directly proportional to its inductance. Accordingly, in order to increase the Q of an electromagnetic resonator one may increase its inductance by increasing the number of turns in inductors incorporated in the resonator (the inductance of an inductor increases in proportion to the square of the number of turns in the inductor); or, one may decrease the resistance of the resonator. Unfortunately, if the resonator inductance is increased by increasing the number of inductor turns, there is a proportional increase of the resonator resistance, due to the addition of resistive inductor turn material. Similarly, if the resonator resistance is decreased by removing resistive inductor turn material, then there is a proportional decrease of the resonator inductance. The result is that the resonator Q can be increased only marginally by this technique.

The foregoing limitations are not of particular concern for resonators having high resonant frequencies, because the resonator Q is also directly proportional to its resonant frequency. However, at low resonant frequencies, such as the audio frequency range, the limitations aforesaid effectively preclude construction of a high Q low frequency resonator. Typically, Q is very much less than 100 for an inexpensive audio frequency resonators practical size.

Recent advances in superconductor technology which have dramatically elevated the minimum temperature at which certain materials become superconductors (i..e. the minimum temperature at which such materials have negligible resistance to the flow of electric current) facilitate the construction of low cost, high Q low frequency resonators. This is because the number of turns of a resonator inductor may be increased, without yielding a corresponding increase in the resonator resistance if the resistive components of the resonator are cooled to the minimum temperature required for those elements to operate as superconductors. Because superconductors have negligible resistance, and because the resonator Q is inversely proportional to its resistance, very high resonator Q may be attained independently of the resonator frequency. Even so it would ordinarily be necessary to separately construct the inductive and capacitive components of-the resonator with superconductor material and then connect those component together with superconductor material. The present invention greatly simplifies resonate construction by facilitating formation of the capacitive and inductive components as unitary superconductor material components.

SUMMARY OF THE INVENTION

In its most general form, the invention provides an electromagnetic resonator, comprising two or more non-intersecting, substantially overlapping surfaces of approximately similar size and shape. The surfaces are separated from one another by a distance which is small in comparison with physical extent of the surfaces. One or more substantially non-intersecting, electrically conductive paths cover substantial portions of each of the surfaces. The widths of the conductive paths are substantially smaller than the physical extent of the surfaces. No conductive path on any one of the surfaces is electrically connected to a conductive path on any of the other surfaces. The conductive paths are oriented such that, for each of the surfaces, "macroscopic current" (hereinafter defined) flows, with respect to the surfaces, in a direction other than the direction in which "microscopic current" (hereinafter defined) flows in the paths. The conductive paths are further oriented such that the electromagnetic resonator supports at least one mode of electromagnetic oscillation between a first state in which the electromagnetic energy stored by the resonator is substantially electrostatic energy, and a second state in which the electromagnetic energy stored by the resonator is substantially magneto-static energy; the frequency of such oscillation being substantially lower than any characteristic self-resonant frequency of electromagnetic oscillation of any one of the paths, taken alone.

The invention further provides an electromagnetic resonator as described above, further comprising first and second electrical conductors respectively traversing non-intersecting paths which conform, respectively, to first and second surfaces. The surfaces and the conductors are separated by a distance "t", such that, over a substantial portion of the region between the surfaces:

(a) $t << R_1$, where $R_1$ is the radius of curvature of the first surface at a selected point;

(b) $t << R_2$, where $R_2$ is the radius of curvature of the second surface at a point on the second surface intersected by a vector normal to the first surface at the selected point;

(c) $t > 0$;

(d) t is measured along the aforementioned vector; and, (e) t is much less than the physical extent of either of the surfaces.

If the end points of the first conductor are defined as "$a_1$" and "$b_1$" respectively, then the analogous end points "$a_2$" and "$b_2$" of the second conductor are defined as those points on the second conductor which, when oppositely charged and having a continuous charge distribution therebetween, produce an electric field distribution, in regions away from the surfaces, which is more similar to the electric field distribution produced, in regions away from the surfaces, by a charge distribution similarly applied to the first conductor than would be the case if the end points $a_2$ and $b_2$ were interchanged. The conductors are configured and positioned relative to one another such that if current flow from $a_1$ to $b_1$ produces a magnetiC field distribution $\bar{B}_1(x,y,z)$; and, current flow from $b_2$ to $a_2$ produces a magnetic field distribution $\bar{B}_2(x,y,z)$; then $\bar{B}_1(x,y,z)$ and $\bar{B}_2(x,y,z)$ are substantially similar, in the sense that a coupling coefficient "C" defined as $C=\int\int\int \bar{B}_1(x,y,z)\cdot\bar{B}_2(x,y,z)dxdydz$ has the property that $C>0$.

The invention further provides an electromagnetic resonator of the general type first described above wherein the conductive paths are further oriented such that current flow through the paths on one of the resonator surfaces, in a direction which transports charge toward the centre of that surface, produces a magnetic field distribution $\bar{B}_1(x,y,z)$, and current flow through the paths on one of the resonator surfaces adjacent said one surface, in a direction which transports charge away from the center of said adjacent surface, produces a magnetic field distribution $\bar{B}_2(x,y,z)$, where $\bar{B}_1(x,y,z)$ and $\bar{B}_2(x,y,z)$ are substantially similar in the sense that a coupling coefficient "C" defined as $C=\int\int\int \bar{B}_1(x,y,z)\cdot\bar{B}_2(x,y,z)dxdydz$ has the property that $C>0$.

Advantageously, the surfaces may be spiral rolls. The conductive paths may advantageously take the form of spirals when the resonator surfaces are laid flat. Preferably, the surfaces are spiral rolls and the conductive paths take the form of spirals when the surfaces are unrolled and laid flat.

The surfaces may also be discs, and the conductive paths may be spirals on the disc surfaces. Alternatively, the surfaces may be spiral rolls and the conductive paths maY be substantially parallel to one another on each of the surfaces. As a further alternative, the surfaces may be spiral rolls; and, on one side of each of the surfaces, the paths may take the form of spirals when the surfaces are unrolled and laid flat; and, on the opposite side of the surfaces, the paths may be substantially parallel to one another.

In any embodiment of the invention the conductive paths are advantageously formed cf superconductor material preferably, thin film, high temperature superconductor material, such as yttrium barium copper oxide with the stoichiometric ratio of the three materials being respectively 1:2:3.

It will be practically advantageous to construct resonators of the general type first described above in which the resonator surfaces are substantially planar and are separated by a substantially constant displacement over the region between the surfaces. For example, the opposed flat surfaces of a disc-shaped insulator may serve as the first and second surfaces, in which case the first and second conductors may be oppositely directed spirals placed, respectively, on the first and second insulator disc surfaces. More particularly, the invention also provides an electromagnetic resonator comprising an electrical insulator having opposed first and second sides. A first electrical conductor which spirals in a first direction is placed on the first side of the insulator. A second electrical conductor which spirals in a second direction opposite to the first direction is placed on the second side of the insulator. The spiral conductors are configured such that current flow through the first conductor, in a direction which transports charge toward the centre of the first conductor spiral produces a magnetic field distribution $\bar{B}_1(x,y,z)$, and current flow through the second conductor, in a direction which transports charge away from the centre of the second conductor spiral produces a magnetic field distribution $\bar{B}_2(x,y,z)$, where $\bar{B}_1(x,y,z)$ and $\bar{B}_2(x,y,Z)$ are substantially similar in the sense that a coupling coefficient "C" defined as $C=\int\int\int \bar{B}_1(x,y,z)\cdot\bar{B}_2(x,y,z)dxdydz$ has the property that $C>0$.

The invention further provides an electromagnetic resonator of the general type first described above, and further comprising a plurality of electrical insulators stacked atop one another. Every second one of the insulators in this stacked embodiment is an electromagnetic resonator functionally identical to the resonators described in the immediately preceding paragraph.

The conductors need not be affixed to the insulator surfaces. They need only traverse non self-intersecting paths which conform to surfaces having the characteristics set forth in the foregoing description of the general form of the invention. Thus, in yet another embodiment, the invention provides an electromagnetic resonator comprising a plurality of "n" electrical insulators stacked atop one another. An electrical conductor which spirals in a first direction is placed between each pair of insulators "i" and "i+1", where:

(i) $i=1, 3, 5, 7, \ldots n-2$ if "n" is an odd number; and, (ii) $i=1, 3, 5, 7, \ldots n-1$ if "n" is an even number.

Another electrical conductor which spirals in a second direction opposite to the first direction is placed between each successive insulator pair "i+1" and "i+2", where:

(i) $i=1, 3, 5, 7, \ldots n-2$ if "n" is an odd number; and, (ii) $i=1, 3, 5, 7, \ldots n-3$ if "n" is an even number.

Here again, the conductors are configured and positioned relative to one another such that current flow through each of the conductors positioned between each pair of insulators "i" and "i+1", in a direction which transports charge toward the centre of the conductor spirals produces a magnetic field distribution $\bar{B}_1(x,y,z)$, and current flow through each of the conductors between the successive pairs of insulators "i+1" and "i+2", in a direction which transports charge away from the centre of the successive insulator pair conductor spirals produces a magnetic field distribution $\bar{B}_2(x,y,z)$, where $\bar{B}_1(x,y,z)$ and $\bar{B}_2(x,y,z)$ are substantially similar in the sense that a coupling coefficient "C" defined as $C=\int\int\int \bar{B}_1(x,y,z)\cdot\bar{B}_2(x,y,z)dxdydz$ has the property that $C>0$.

The invention further provides a method of making an electromagnetic resonator in which spiral-shaped electrical conductors are applied to the surfaces of one or more planar insulators, such that conductors on one side of each of the insulators spiral in a first direction, and conductors on the opposed sides of each of the insulators spiral in a second direction opposite to the first direction. The insulators are then stacked atop one another.

The invention further provides a method of making an electromagnetic resonator in which electrical conductors are applied diagonally across the surfaces of two or more planar insulators. The insulators are placed atop one another such that conductors on adjacent surfaces of the insulators lie in different directions. The insulators are then rolled together to form a spiral roll.

The invention also provides a method of making an electromagnetic resonator in which an electrical conductor is applied to a surface of a first planar insulator, such that the conductor extends around the outer region of the insulator surface in spiral fashion. A plurality of discrete electrical conductor segments are applied to the corresponding outer region of a surface of a second planar insulator. The first and second insulators are then placed atop one another, such that conductors on adjacent surfaces of the insulators line in different directions. The insulators are then rolled together to form a spiral roll.

DETAILED DESCRIPTION OF THE PREFERRED EMBODIMENTS

Figure 1:
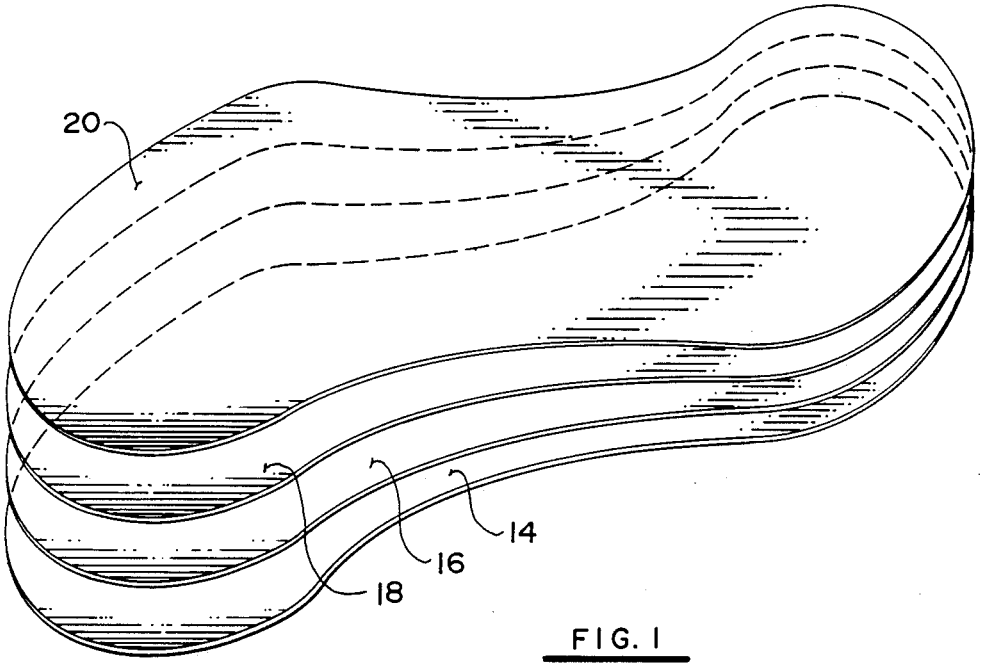
FIG. 1 depicts a plurality of non-intersecting, substantially overlapping surfaces capable of defining a generalized electromagnetic resonator in accordance with the invention.

To assist those skilled in the art, certain geometrical relationships will first be defined. Electromagnetic resonators constructed in accordance with the invention incorporate two or more non-intersecting, substantially overlapping surfaces of approximately similar size and shape which are separated from one another by a distance which is small in comparison to the physical extent of the surfaces. FIG. 1 illustrates four such surfaces 14, 16, 18 and 20. Surface 20 is further depicted in FIG. 2, which also illustrates a thin film structure 22 applied to surface 20 Structure 22 incorporates a number of non-intersecting, electrically conductive paths 24, 26 and 28 which cover a substantial portion of. surface 20 (the paths may be applied directly to surface 20, but the use of thin film path-bearing structures is considered to be practically convenient). The width of each of paths 24, 26 and 28 is substantially smaller than the physical extent of surface 20. Similar conductive path-bearing structures (not shown) are provided on each of surfaces 14, 16 and 18. No conductive path on any one of the surfaces is electrically connected to a conductive path on any of the other surfaces.

There are an infinite number of widely differing surfaces, structures and paths having characteristics of the sort described in the preceding paragraph. The present invention is directed to a particular subset of such structures having particularly useful electromagnetic characteristics. To assist those skilled in the art in comprehending this subset; it is useful to develop the concept of "macroscopic" and "microscopic" currents.

Figure 2:
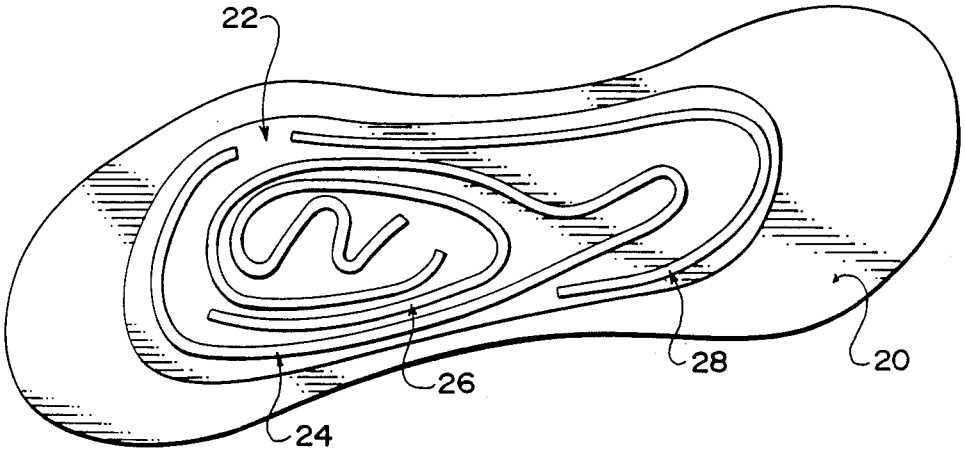
FIG. 2 illustrates one of the surfaces of FIG. 1, having a plurality of substantially non-intersecting, electrically conductive paths covering a substantial portion of the surface.

If surfaces 14, 16, 18 and 20 of FIG. 1 each bear a conductive structure such as structure 2,2 depicted in FIG. 2, it will be realized that the group of conductive structure-bearing surfaces as a whole has a significant similarity to a parallel plate capacitor, in which substantially equal but opposite surface charge densities exist on adjacent regions of the conductive structures. In relation to conventional capacitors which are incorporated in a resonant circuit, and also in relation to the conductive structures contemplated by the present invention, it is meaningful to discuss the change of distribution of surface charge in a macroscopic sense, and to define "macroscopic current" as the gradient of the time derivative of the macroscopic surface charge distribution. Consider for example FIG. 3, which illustrates a resonator comprising circular surfaces 32, 34 and 36 to which spiral shaped conductive structures 33, 35 and 37 are respectively applied. It will be noted that spirals 33 and 37 spiral outwardly in a clockwise direction from the centre of surfaces 32 and 36 respectively, whereas spiral 35 spirals outwardly in a counterclockwise direction from the centre of surface 34. Those skilled in the art will accordingly appreciate that the mode of oscillation of electromagnetic energy in these spirals consists of an alteration from, a state in which the central regions of the two clockwise spirals 33, 37 are predominantly positively charged, with their respective peripheral regions negatively charged, and the opposite situation prevailing on the counterclockwise spiral 35 (namely, the central region of the counterclockwise spiral 35 is predominantly negatively charged, and the peripheral region of the counterclockwise spiral 35 is predominantly positively charged); to a state in which the central regions of the two clockwise spirals 33, 37 are predominantly negatively charged, with their respective peripheral regions positively charged, and the opposite situation prevailing on the counterclockwise spiral 35 (i.e. the central region of spiral 35 is predominantly positively charged, and the peripheral region of spiral 35 is predominantly negatively charged). In this situation, the "macroscopic currents" in the conductive structures are directed radially inwardly and outwardly as the oscillation occurs. This oscillation is hereinafter described in greater detail, but at the moment the important concept to note is that for a given conductive structure and a given mode of oscillation, there is a well defined macroscopic current, distribution.. which reflects the overall macroscopic flow of charge in the structure.

The actual or "microscopic" electric current which flows as charge moves from one region of any conductive structure to another must of course follow the physical conductive paths which make up the conductive structure. The actual "mircroscopic" flow of electric current in any given region of the conductive structure may be in a direction which is substantially different from the direction of overall macroscopic current flow and may be substantially greater than the magnitude of the macroscopic current flow. The present invention exploits this difference between macroscopic and microscopic currents.

Figure 3:
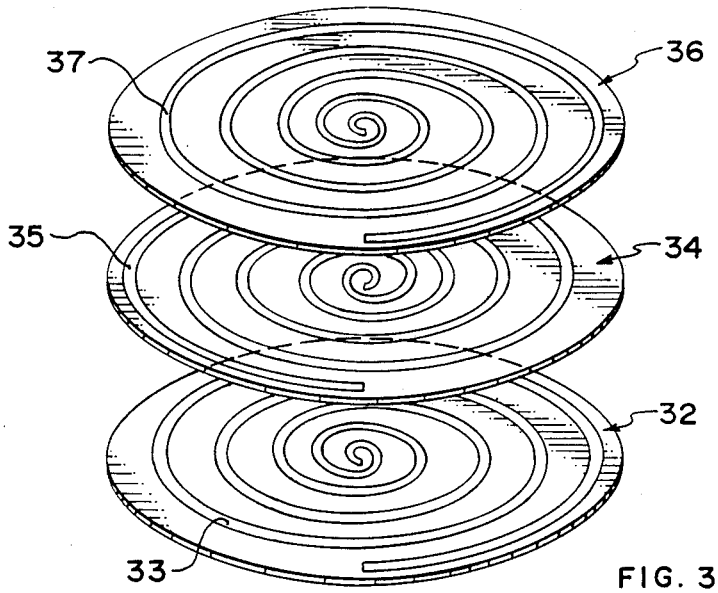
FIG. 3 is an oblique perspective view of an electromagnetic resonator constructed in accordance with one embodiment of the invention.

Since the macroscopic charge densities of vertically adjacent regions of conductive structures 33, 35 and 37 depicted in FIG. 3 are essentially equal and opposite, it is in general true that the macroscopic currents occurring within adjacent conductive structures tend to be substantially equal and opposite. Equal and opposite surface currents produce relatively little magnetic field energy. However this is irrelevant for present purposes because the currents which are actually responsible for creating magnetic fields are the actual microscopic currents which flow in the conductive structures. The present invention recognizes that it is possible to structure the shape of the conductive paths on adjacent resonator surfaces in such a manner that the microscopic currents are not substantially equal and opposite on adjacent surfaces of the resonator and are accordingly capable of producing magnetic fields which are additive and which extend through a significant volumetric region. This results in a resonator having a high capacitance, high inductance characteristic which enables electromagnetic oscillation to occur at a comparatively low frequency. Since an arbitrary conductive structure will have a natural self-resonant frequency determined by its self-inductance and self-capacitance, a structure having the aforementioned high capacitance, high inductance characteristic can be defined as one whose resulting electromagnetic resonance is substantially lower in frequency than any characteristic self-resonant frequency of electromagnetic oscillation of any one of the conductive paths incorporated in the structure, taken alone.

The nature of the electromagnetic oscillation herein contemplated consists of alterations from a state in which the electromagnetic energy is primarily electrostatic energy stored substantially between the resonator surfaces, to a state in which the electromagnetic energy is primarily magnetostatic energy.

Although the embodiment depicted in FIG. 3 shows only three spirals, any number of spirals greater than one may be employed to construct an electromagnetic resonator in accordance with the invention. The spirals on adjacent surfaces alternate from clockwise to counterclockwise as depicted in FIG. 3. This results in microscopic currents which at any given time flow in the same direction. At the beginning of the electromagnetic oscillation cycle, there are essentially no currents and essentially all of the resonator's electromagnetic energy takes the form of electrostatic energy stored between the resonator surfaces, corresponding to the fields resulting from a charge distribution which is predominantly positive in the center and negative in the periphery of the clockwise spirals 33, 37; and the opposite (i.e. negative centre and positive periphery) for the counterclockwise spiral 35. As the oscillation cycle progresses, this charge distribution is reduced and then built up in the opposite sense, as a result of macroscopic current flows which are radial and opposite on adjacent resonator surfaces. Despite the fact that the macroscopic currents on adjacent resonator surfaces oppose one another, the fact that adjacent resonator surfaces have an alternating sense of spiral causes the corresponding microscopic currents to be entirely in the clockwise direction during the first half of the oscillation cycle. As a result, large scale strong magnetic fields are created, predominantly in a direction perpendicular to the spirals. Midway through the oscillation process, the charge distribution in the resonator is neutralized, but there is an intense magnetic field, so that most of the energy is electromagnetic at this point. Then, the opposite electrostatic end of the oscillation cycle is reached, as the currents drop to zero and most of the resonator's electromagnetic energy again takes the form of electrostatic energy stored between the resonator surfaces, but with a charge distribution precisely opposite to that which prevailed when. the oscillation cycle began. The second half of the oscillation cycle is the precise inverse of the first half and the cycle is then complete. As may be seen, the essence of the invention lies in the fact that the orientation of the resonator's conductive paths pause the microscopic currents to be additive even as the macroscopic currents are equal and opposite is response to the capacitive interaction of the conductive structures.

There are many alternative ways of constructing a resonator having the general oscillation characteristics described above. For example, spiral conductive structures can be formed on disc-shaped insulators by means of printed circuit, thin film or integrated circuit fabrication techniques. One approach would be to deposit spiral conductors on opposed surfaces of insulators and then separate the spiral-bearing insulators from one another with insulators having no conductors. The spiral conductive structures need not be physically connected to the insulators, although it may be useful to employ some form of connection in constructing electromagnetic resonators in accordance with the invention.

An important advantage of the invention is that there exist techniques for making very thin insulators with very finely detailed conductive paths. Accordingly, it is possible to have a great deal of capacitance present..(due to large number of surfaces which can be placed in a small volume) and a large amount of inductance present (due to large relative lengths of the conductive paths in question) so the frequency of oscillation can be very low. In general, one would expect a relatively low Q to result, due to the high resistance to current flow in such a fine structure. This can however be overcome by forming the conductive path with superconducting material, more particularly, thin film, high temperature superconducting material, such as yttrium barium copper oxide with the stoichiometric ratio of the three materials being respectively 1:2:3.

Figure 4:
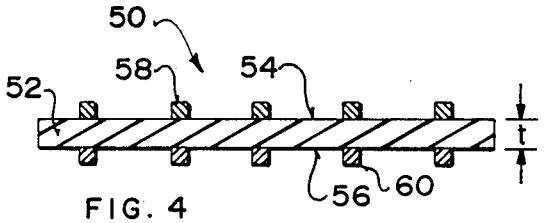
FIG. 4 is a side elevation view of an electromagnetic resonator in accordance with another embodiment of the invention; the vertical dimension being greatly exaggerated in comparison to the horizontal dimension.
Figure 5:
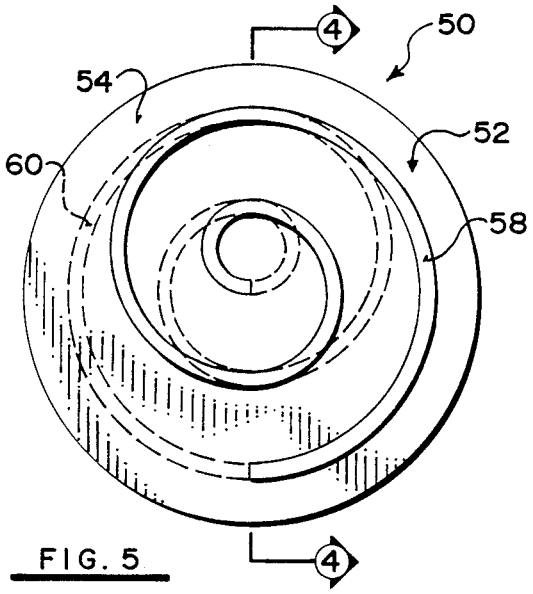
FIG. 5 is a top elevation view of the electromagnetic resonator of FIG. 4; hidden lines being used to illustrate the conductor spiral on the side of the resonator which is beneath the plane of the paper; and the displacement between radially adjacent segments of each of the conductors being greatly exaggerated in comparison to the displacement across a single segment of either conductor.

FIGS. 4 and 5 illustrate an electromagnetic resonator 50 according to a first preferred embodiment of the invention. Resonator 50 comprises an electrical insulator 52 having opposed first and second sides 54, 56. A first electrical conductor 58 (preferably, but not necessarily, formed of superconductor material) which spirals outwardly from the centre of insulator 52 in a first direction (which happens to be clockwise, as illustrated in FIG. 5), is etched or bonded onto insulator first side 54; for example, using printed circuit, thin film or integrated circuit fabrication techniques, depending upon the desired degree of miniaturization of the conductors. A second electrical conductor 60 (also preferably, but not necessarily, formed of superconductor material) which spirals outwardly from the centre of insulator 52 in a second direction opposite to the first direction aforesaid (the "second" direction happens to be counterclockwise, as illustrated in FIG. 5, because the "first" direction is clockwise in the example of FIG. 5) is similarly etched or bonded onto insulator second side 56. Spiral conductors 58, 60 are in all respects identical, except they spiral in opposite directions.

Current which is induced to flow through first conductor 58, in a direction which transports charge toward the centre of the first conductor spiral produces a magnetic field distribution which is defined as $\overline{B}_1(x,y,z)$. Current induced to flow through second conductor 60, in a direction which transports charge away from the centre of the second conductor spiral produces a magnetic field distribution which is defined as $\overline{B}_2(x,y,z)$. Because conductors 58, 60 are identical, except for their opposite spirals, and because they are positioned vertically adjacent one another on opposite sides 54, 56 of insulator 52, $\overline{B}_1(x,y,z)$ is substantially similar to $\overline{B}_2(x,y,z)$, in the sense that a coupling coefficient "C" defined as $C=\int\int\int\overline{B}_1(x,y,z)\cdot\overline{B}_2(x,y,z)dxdydz$ has the property that $C>0$.

Note that the coordinate system used to define the magnetic field distribution vectors is entirely arbitrary, relative to the structural orientation of conductors 58, 60. More particularly, the coefficient "C" would be the same, no matter what coordinate system were chosen. Consider for example two vectors $R_1$, $R_2$ which are perpendicular. This may be expressed mathematically as $C=\int\int\int R_1\cdot R_2=0$. The coefficient C is obtained by integrating the dot product of two vectors. Generally, a dot product of two vectors is a scalar quantity whose value is by definition independent of the coordinate system chosen to represent the vectors.

Although not essential, it will be preferable and practically advantageous, in order to facilitate simplified construction of inexpensive resonators, to ensure that the displacement "t" between insulator sides 54, 56 is substantially constant. It will also be advantageous to ensure that insulator sides 54, 56 are substantially planar, although this is not essential; for example, the insulator may be a cylinder, or it may have other arbitrary curvature. It will also be practically advantageous to form insulator 52 as a disc as shown in FIG. 5, although this is not essential either—insulator 52 may have any desired shape. Moreover, it is not essential that conductor spirals 58, 60 be centered with respect to insulator 52 (although it is important to ensure that the spirals are sufficiently well centred with respect to one another to ensure substantial similarity of the magnetic field distributions as aforesaid). Similarly, spiral conductors 58, 60 need not extend from the outer rim of insulator 52 to the centre of insulator 52—the conductors may stop short of the rim and/or the centre of insulator 52.

Generally, one need only provide first and second electrical conductors which traverse non self-intersecting paths which conform, respectively, to first and second surfaces, such that the surfaces and the conductors are separated by a distance "t" $>0$. Over a substantial portion of the region between the surfaces, should have the following characteristics: $t<<R_1$, where as shown in FIG. 4 $R_1$ is the radius of curvature of the first surface at a selected point throughout this application, the phrase radius of curvature"of a surface is used to mean the smallest of the radii of curvature, at any particular point of the surface, of the family of curves formed by intersections of the surface with the family of planes which contain a vector normal to the surface at the particular point); $t<<R_2$, where. Rz is the radius of curvature of the second surface at a point on the second surface intersected by a vector normal to the first surface at said selected point (see FIG. 4); t is measured along said vector; and, t is much less than the physical extent of either of the surfaces. The end points of the first conductor are defined as "$a_1$" and "$b_1$" respectively. The analogous end points "$a_2$" and "$b_2$" of the second conductor are defined as those points on the second conductor which, when oppositely charged and having a continuous charge distribution therebetween, produce an electric field distribution, in regions away from the surfaces, which is more similar to the electric field distribution produced, in regions away from the surfaces, by a charge distribution similarly applied to the first conductor, than would be the case if the end points $a_2$ and $b_2$ were interchanged (end points $a_1$, $a_2$, $b_1$, and $b_2$ are not associated with any particular figure). The conductors are configured and positioned so that current flow from $a_1$ to $b_1$ produces a magnetic field distribution $\overline{B}_1(x,y,z)$; and, current flow from $b_2$ to $a_2$ produces a magnetic field distribution $\overline{B}_2(x,y,z)$; where $\overline{B}_1(x,y,z)$ and $\overline{B}_2(x,y,z)$ are substantially similar in the sense that a coupling coefficient "C" defined as $C=\int\int\int\overline{B}_1(x,y,z)\cdot\overline{B}_2(x,y,z)dxdydz$ has the property that $C>0$.

Figure 6:
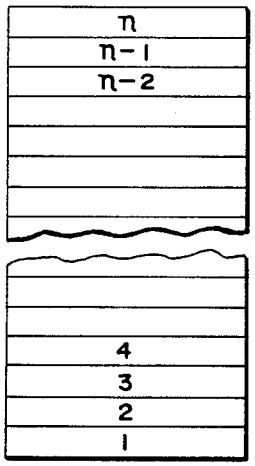
FIG. 6 is a side elevation view of a "stacked" electromagnetic resonator in accordance with another embodiment of the invention.

FIG. 6 illustrates second and third embodiments of the invention, both of which contemplate a plurality of "n" electrical insulators stacked atop one another to a height "H". For ease of reference, FIG. 6 shows an insulator stack 70, comprising insulators labelled "1", "2", "3", . . . "n−2", "n−1", "n". Spiral conductors are located between successive inductor pairs as hereinafter described. In the second embodiment of the invention, insulators having electrically conductive spirals etched or bonded thereon as described above with reference to FIGS. 4 and 5 are alternated in stack 70 with insulators having no conductors. In the third embodiment of the invention, none of the insulators in stack 70 have conductors etched or bonded onto them as in the first and second embodiments; instead, discrete spiral conductors are placed between adjacent insulators in the manner hereinafter explained.

Dealing first with the second embodiment of the invention, every second one of the insulators in stack 70 is identical to electromagnetic resonator 50 described above with reference to FIGS. 4 and 5. That is, every second one of the insulators in stack 70 has first and second oppositely directed spiral conductors on opposed sides thereof. Insulators having no conductors are positioned between each of the conductor-bearing insulators to form stack 70. The number of insulators "n" in stack 70 may be odd or even. Moreover, the conductor-bearing insulators within stack 70 may be either the odd or the even numbered insulators.

In the third embodiment, none of the insulators comprising stack 70 have conductors etched or bonded onto them. Instead, discrete conductor spirals (which may for example be thin film conductors on insulating thin film substrates, or wafer thin conductors without substrates) are placed between adjacent insulators to duplicate the characteristics of a stack constructed in accordance with the second embodiment of the invention. More particularly, an electrical conductor which spirals in a first direction is placed between each pair of insulators "i" and "i+1" in stack 70. If the total number of insulators "n" in stack 70 is an odd number, then $i=1, 3, 5, 7, \ldots n-2$. If "n" is an even number, then $i=1, 3, 5, 7, \ldots n-1$. An electrical conductor spiralling in a second direction opposite to the first direction is positioned between each 15 successive insulator pair "i+1" and "i+2". For the conductors placed between the successive insulator pairs, $i=1, 3, 5, 7, \ldots n-2$ if the total number of insulators "n" in stack 70 is an odd number; or, $i=1, 3, 5, 7, \ldots n-3$ if "n" is an even number. The oppositely spiralling conductors are so configured and positioned that current which is induced to flow through each of the conductors between each pair of insulators "i" and "i+1", in a direction which transports charge toward the centre of the conductor spirals produces a magnetic field distribution defined as $B_1(x,y,z)$, and current induced to flow through each of the conductors between the successive pairs of insulators "i+1" and "i+2", in a direction which transports charge away from the centre of the successive insulator pair conductor spirals produces a magnetic field distribution defined as $\bar{B}_2(x,y,z)$, such that $\bar{B}_1(x,y,z)$ is substantially similar to $\bar{B}_2(x,y,z)$ in the sense that a coupling coefficient "C" defined as $C=\int\int\int \bar{B}_1(x,y,z)\cdot\bar{B}_2(x,y,z)dxdydz$ has the property that $C>0$.

Advantageously, the resonator is encapsulated in a dielectric material to minimize mechanical vibration of the conductors.

A simplified mathematical analysis of the invention is now presented. The analysis is similar in nature to the precise calculations that would be applicable to any given embodiment of the invention, which in general would have to be performed numerically.

Figure 7:
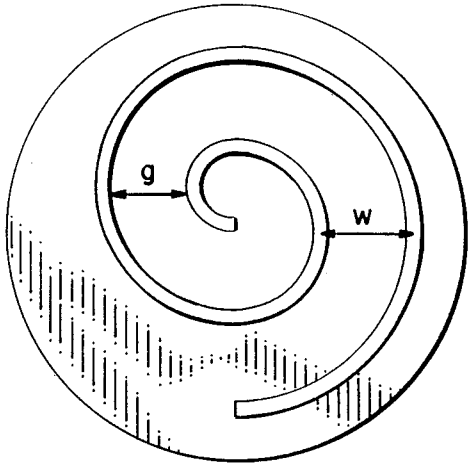
FIG. 7 is similar to FIG. 5, but shows only the conductor spiral on the insulator surface which is above the plane of the paper.
Figure 8:
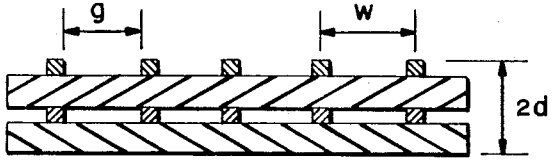
FIG. 8 is a side elevation view of a portion of the electromagnetic resonator of FIG. 6; the vertical dimension in FIG. 8 being greatly exaggerated in comparison to the horizontal dimension.

The analysis pertains to a stack of resonators constructed in accordance with the second or third embodiments of the invention. The following assumptions are made with reference to FIGS. 7 and 8:

Let:

w = the displacement between the centres of radially adjacent segments of a given conductor spiral.

g = the displacement between adjacent edges of radially adjacent segments of a given conductor spiral.

2d = the thickness of one spiral conductor-bearing insulator plus one non conductor-bearing insulator (in the second embodiment); or, the thickness of two non conductor-bearing insulators plus the thickness of conductor spirals placed on opposite sides of one of those insulators (in the third embodiment).

H = the height of the insulator stack (see FIG. 6).

$n_H$ = the number of conductors in the stack.

r = the radius of a disc-shaped insulator (which therefore has surface area $A=\pi r^2$).

$\epsilon_o$ = the permittivity of free space.

$\epsilon_r$ = the relative permittivity of the insulator dielectric material.

$\mu_o$ = the permeability constant.

$n_s = r/w$ = the number of spiral turns per conductor.

Let there be a peripheral region defined to be the region outside a circle of radius $=\sqrt{\frac{1}{2}r}$ (such radius pertaining to no particular figure).

Although the following assumptions are not essential for resonance to occur, they facilitate derivation of the typical frequency of operation of the device. Hence, assume:

1. The insulators are disc-shaped.
2. The conductor spirals are tightly packed and cover substantially all of the insulator surfaces.
3. $g << w$.
4. $d \approx t$.

For analytical purposes the resonator may be viewed as consisting of lumped inductances and capacitances, even though such inductances and capacitances coexist intimately with one another in the actual resonator. Such treatment is common in circuit analysis, and generally yields a reasonable approximation, provided that the wavelengths associated with the electromagnetic oscillations are large compared to the physical extent of the device. For example., it is not unusual in conventional circuit analysis to view a real inductor as a combination of an ideal inductor connected in parallel with a small capacitor (which represents the capacitance between the inductor windings) and connected in series with a resistor (which represents the resistance of the inductor windings).

In the present case, such a lumped components model can be made by considering the mode of electromagnetic oscillation of the resonator. As with most electromagnetic resonators, the electromagnetic energy in the oscillation alternates between states of predominantly electric field energy and states of predominantly magnetic field energy. In the present resonator these are states where, first, most of the electromagnetic energy is in an electric field between adjacent conductors, that field being perpendicular to. and primarily confined between the surfaces to which those conductors conform; and, second, where the energy is predominantly in a magnetic field which is also perpendicular to the surfaces to which the conductor paths conform, but which extends significantly throughout the resonator, beyond the region between the surfaces to which any two adjacent inductors conform, so that the magnetic field lines are shared by several conductors. In terms of the motion of charge, the resonator alternates between a state in which the peripheral regions of a given conductor are charged oppositely to the central region of that conductor and also oppositely to the peripheral regions of the immediately adjacent conductor(s); and a state in which opposite charges prevail in each of those regions. In the oscillation between these two states, there are current flows on the spiral conductors, with all such flows producing magnetic fields which add to one another. A convenient way of viewing this oscillation is to think of a plane midway between each pair of adjacent conductors as a plane of zero electrical potential.

Figure 9:
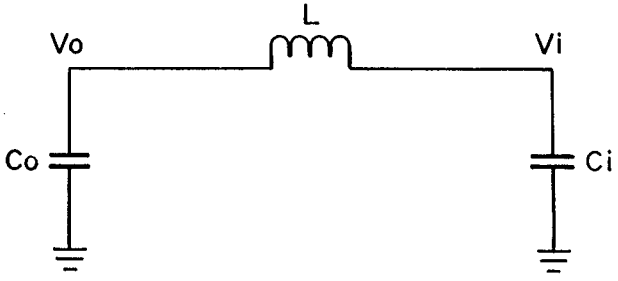
FIG. 9 is a circuit schematic diagram of a lumped components model of the invention.

From this point of view, each conductor can be viewed as the equivalent of the lumped circuit shown in FIG. 9, where the ground symbols represent zero potential points. The two capacitances $C_o, C_i$ correspond respectively to the inner and outer 50% of the area of the disc, where the capacitance is between the conductor in these two regions and the plane of zero electrical potential. The effective lumped inductance K is of course caused by the turns of the spiral conductor. We can now proceed with calculation of the resonant frequency, bearing in mind that this is an approximate treatment only. Two cases are analyzed; one in which the product $n_H d$ is very much greater than r; the other in which $N_H d$ is very much less than r.

Consider first the case in which $n_H d$ is very much greater than r. For a general parallel plate capacitor it is known that $C=(F_c\epsilon_o\epsilon_r A_c)/d_c$, where $A_c$ is the plate area, $d_c$ is the plate separation and $F_c$ is a geometric factor of order 1. Since the plane of zero potential in this model is midway between the conductor plates, we have $d_c=d/2$. Since each capacitor occupies half the disc area, we have $A_c=\frac{1}{2}(\pi r^2)$. Therefore, $C_o=C_i=F_c\epsilon_o\epsilon_r\pi r^2/d$. Intuitively, a reasonable guess for $F_c$ in this situation might be approximately $\frac{1}{4}$, multiplied by 2 to take into account the fact that each plate "sees" two adjacent zero potential surfaces. Therefore F is about 1. Accordingly, $C_o=C_i=[_o\epsilon_r\pi r^2/d$.

If q(t) is the excess positive charge resident in the peripheral region of the conductor at any time, then $-q(t)$ is the complimentary charge in the inner region of that conductor. By the definition of capacitance, then, $$V_o=q/c_o=q/(F_c\epsilon_o\epsilon_r\pi r^2/d)$$

If we define the voltage across the inductor to be $V_L=V_o-V_i$, we have therefore:

$$\begin{aligned} V_L &= (2/\pi)(1/(F_c\epsilon_o\epsilon_r))((d/r^2)q) \\ &= (2/\pi)(1/(\epsilon_o\epsilon_r))((d/r^2)q) \end{aligned}$$

$V_L$ must also equal the rate of change of magnetic flux in the inductor: $V_L=\dot{\phi}$. To calculate $\phi$, we must assume that all conductor layers are oscillating in the same manner in phase, which will be found to be a self-consistent assumption. Assuming also that $n_Hd>>r$, we employ the formula for the magnetic field of a solenoid. Further, let us model the actual winding to consist of $n_s/2$ turns at a radius of $\sqrt{\frac{1}{2}}r$, which is the boundary between $C_o$ and $C_i$, Here we can use the formula:

$$B_s=-F_L\mu_o(NI)/H$$

where the sign takes into account Lenz's law, and where N is the total number of turns (in this case $N=n_Hn_s$), I is the current (in this case $\dot{q}(t)$), H is the length (in this case $n_Hd$), and $F_L$ is a geometric factor of order 1 (in this case approximately 1 seems a good intuitive guess).

Further, the flux in this coil is simply $\phi=BAn_s/2$, since we have modelled the number of turns to be $n_s/2$. Therefore:

$$\begin{aligned} V_L &= \dot{\phi}_L \\ &= ((-\tfrac{1}{2}\pi r^2)\tfrac{1}{2}n_s)F_L\mu_o((n_Hn_s)/(n_Hd))\ddot{q}(t) \\ &= (-\tfrac{1}{4}\pi)F_L\mu_o(n_s^2/d)\ddot{q}(t) \\ &= (-\tfrac{1}{4}\pi)\mu_o(n_s^2/d)\ddot{q}(t) \end{aligned}$$

And, noting that the two equations for $V_L$ must be equal:

$$(2/\pi)(1/\epsilon_o\epsilon_r)(d/r^2)q=-((\tfrac{1}{4}\mu)\mu$$

This form is the differential equation for a simple harmonic oscillator, whose well known solution is sinusoidal oscillations, (as expected), with frequency "f", of $f=(1/(2\pi))(a/b)^{\frac{1}{2}}$.

Therefore:

$$f=(1/(2\pi))((2/\pi)(1/(\epsilon_o\epsilon_r))(d/r^2)(4/\pi)(1/\mu_o)(d/n_s^2))^{\frac{1}{2}}$$

Now, $n_s=r/w$, and $1\sqrt{\epsilon_o\mu_o}=c$, the speed of light Hence upon simplification, we have for the case in which $n_Hd>>r$:

$$f\approx(\sqrt{2}/\pi^2)(c/2)(1/\sqrt{\pi_r})(wd/r^2)$$

Thus the oscillation frequency can be seen to be that characteristic of low frequency modes of cavity resonators of characteristic dimension r, reduced by a factor $r^2/wd$, which is approximately the total number of turns in a one radius length of the solenoidal structure.

Now consider the case in which $n_H$ is very much less than r. The previous calculation is appropriate in this case as well, except that the formula for magnetic flux in the inductor is reduced by the fact that fewer spiral conductors contribute to the magnetic flux in any one inductor.

A reasonable estimate for the reduction factor is:

$$R=(2/\pi)\tan^{-1}(L/r)\approx(2/\pi)(L/r)=(2/\pi)(n_Hd/r)$$

Since the frequency will vary inversely with the square root of this factor, we have for $n_H>>r$, but for $n>>1$;

$$f=(\sqrt{2}/\pi^2)(\pi/2)^{\frac{1}{2}}(c/r)(1/\sqrt{\epsilon_r})(wd/r^2)(r/h_Hd)^{\frac{1}{2}}$$

In an experimental test with two conductors, such that $n_H=2$, with $d=6.3\times10^{-3}$m, $r=4.3\times10^{-2}$m, $\epsilon_4=2.25$, $w=7\times10^{-4}$m, a frequency of approximately 4.6 MHz was obtained.

In this extreme case, where each conductor sees only one, rather than two zero potential surfaces, a further increase of $\sqrt{2}$ in frequency is expected over the above formula, thus predicting 5.2 MHz, in reasonable agreement considering the approximate nature of the calculation.

As an example, it is interesting to estimate the resonant frequency of a resonator consisting of 1000 spiral insulator-separated conductors with d equal 0.1 mm, with a radius r of 0.1 m and the relative dielectric constant $\epsilon_r=2$ and w=0.1 mm. This is a case which is intermediate between the two cases analyzed above, and for which both formulas give approximately the same answer of 280 hertz. This is a very low frequency for a resonator which does not employ ferromagnetic components, and it would be most unusual to have a-very high Q for such a device, but such high Q is expected. when the conductors are super conductors.

Figure 10:
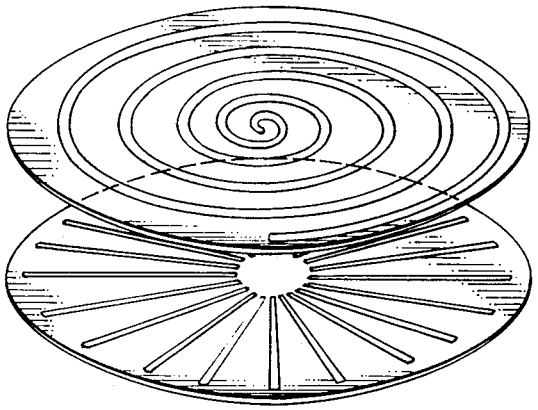
FIG. 10 is an oblique perspective view of an alternative embodiment of the invention showing a spiral conductive path on one surface of the resonator and a plurality of discrete radial conductive paths on an adjacent surface of the resonator.

The analysis of a particular embodiment in terms of lumped components helps to clarify possible variations between ideal and actual resonators, both of which are within the scope of the present invention. An actual device may vary from the ideal such that its resonant frequency is increased (a generally undesirable effect) but the device could have some other merit in terms of quality control, ease of fabrication, or other advantages. An example is the situation where one or more of the spiral conductors of an ideal device is replaced with a multiplicity of non self-intersecting conductors which spiral toward the centre of the device, each conductor having a different number of turns. In an extreme case, for example, the conductors between every second pair of insulators could consist of a very large number of unconnected conductors running radially from the outside toward the centre of the insulator surfaces, as depicted in FIG. 10. In such an embodiment, there is still lumped capacitance in the peripheral region and central region of each adjacent set of conductors, and there is still as effective inductance associated with the oscillating current flows, which still necessarily must pass through spiral windings. Because the radial multiple conductor layers do not substantially contribute inductance, the overall inductance in the device would be reduced, and the oscillation frequency would be increased, but nevertheless the basic mode of electromagnetic oscillation would be the same.

Thus with all embodiments of this device, the key aspect of the design is that electromagnetic oscillations of the form described above occur, and variations from the ideal design described above which may be desirable from some practical point of view are allowable, providing they do not substantially alter the mode of electromagnetic oscillation.

Figure 11A:
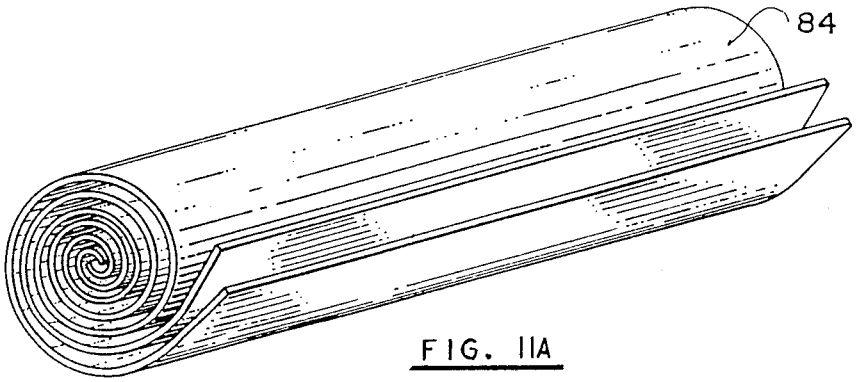
FIG. 11 illustrates another embodiment of the invention consisting of two conductive path-bearing planar insulators (portions of which are depicted in FIGS. 11(*b*) and 11(*c*) respectively) laid atop one another and rolled together to form a spiral roll as shown in FIG. 11(*a*).
Figure 11B:
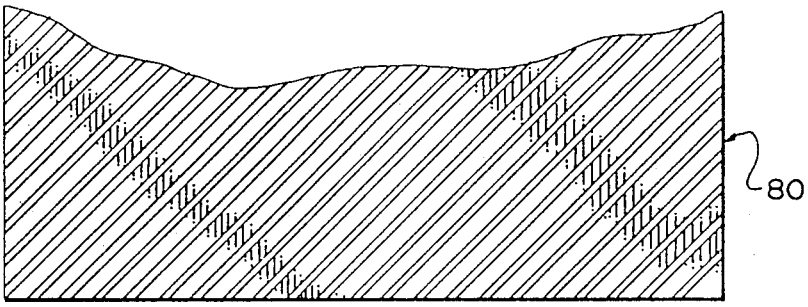
Figure 11C:
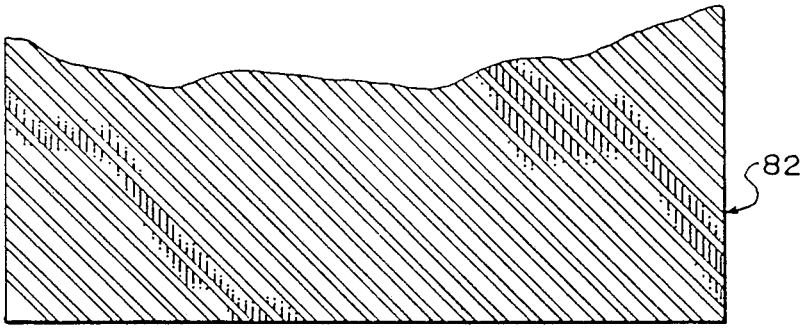

FIG. 11 depicts a fourth embodiment of the invention which nevertheless incorporates all of the basic characteristics of the generalized subset of electromagnetic resonators described above. The embodiment depicted in FIG. 11 employs two planar insulators 80 and 82 illustrated in FIGS. 11(*b*) and 11(*c*) respectively. A plurality of electrically conductive paths are applied to surfaces 80 and 82 respectively. The paths on each surface lie substantially parallel to one another. To construct the electromagnetic resonator of this embodiment (which is illustrated with reference numeral 84 in FIG. 11(*a*)) the conductive path-bearing surfaces 80 and 82 are laid atop one another, such that the conductive paths on each surface lie in different directions. Surfaces 80 and 82 are then rolled together to form a spiral roll. For this particular embodiment, one particular state of extreme electrostatic energy occurs when one end of roll 84 is predominantly positively charged on one of the two surfaces and is predominantly negatively charged at the same end on the other surface; with the exact opposite charge distribution appearing at the other end of roll 84. As the macroscopic currents flow equally and oppositely on the two surfaces in the direction of the longitudinal axis of roll 84, the microscopic currents have substantial components around the axis, and are additive, thus achieving the required characteristics for the resonator to operate in accordance with the invention as described above.

Figure 12A:
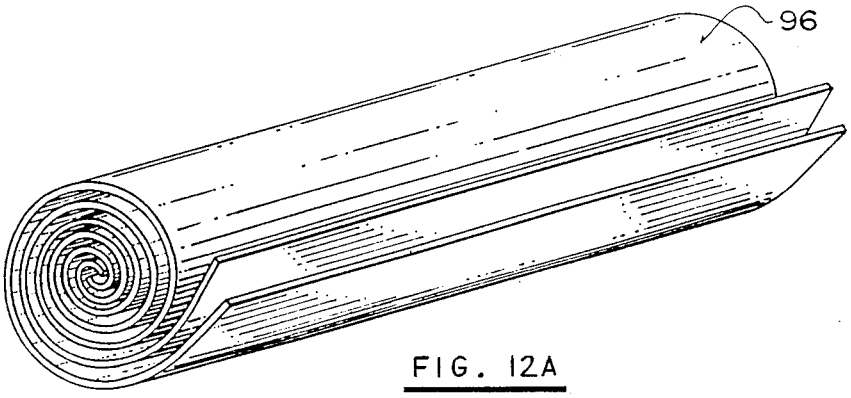
FIG. 12 depicts another embodiment of the invention in which planar insulators (portions of which are depicted in FIGS. 12(*b*) and 12(*c*) respectively) having a different pattern of conductive paths are rolled together to form a spiral roll as shown in FIG. 12(*a*).
Figure 12B:
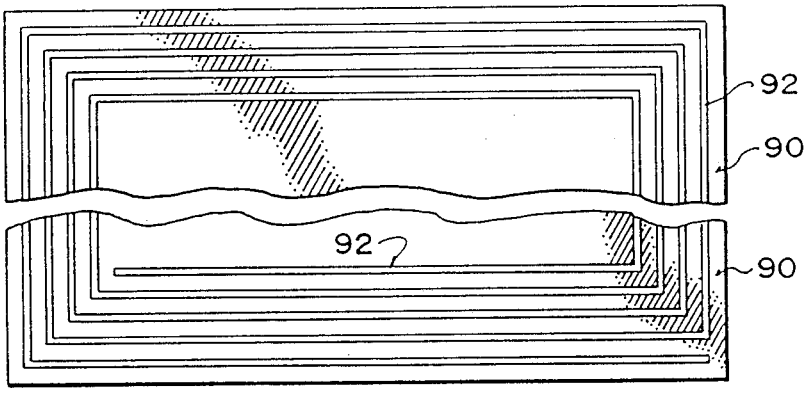
Figure 12C:
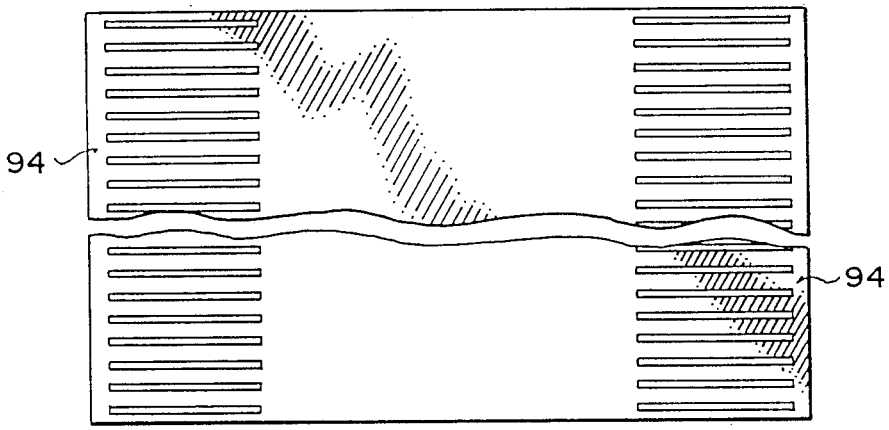

While the embodiment of FIG. 11 has the advantage of easy construction, improved resonator performance may be attained by employing the fifth embodiment of the invention, which is depicted in FIG. 12, and in which the length of the conductive path on one of the resonator surfaces is increased significantly. Generally, the longer the individual conductive paths are, the greater the effective inductance associated with such paths and hence the lower the resonant frequency that may be attained. As depicted in FIG. 12(*b*), surface 90 (a large portion of which has been removed so that both ends of surface 90 could be included in the illustration) has a conductive path 92 which extends around the outer region of surface 90 in spiral fashion (the term "spiral" is here used in a relative sense, in as much as surface 90 is generally rectangular as depicted in FIG. 12). Surface 94, depicted in FIG. 12(*c*) bears a large number of short conductive paths. The two conductive path-bearing surfaces 90 and 94 are laid atop one another and then rolled together to form a spiral roll 96 as depicted in FIG. 12(*a*). Although the mode of oscillation of this structure is similar to that described above with reference to FIG. 11, very significantly lower resonant frequencies can be achieved.

As will be apparent to those skilled in the art, in light of the foregoing disclosure, many alterations and modifications are possible in the practice of this invention without departing from the spirit or scope thereof. For example, instead of placing a single spiral conductor on each of the opposed sides of a conductor-bearing insulator, equal pluralities of oppositely spiralling conductors may be placed on, or positioned with reference to, the opposed insulator sides. Here again, the conductors are configured such that the current flow through any one conductor on one side of an insulator, in a direction which transports charge toward the centre of that conductor spiral produces a magnetic field distribution $B_1(x,y,z)$, and current flow through a vertically opposed conductor, in a direction which transports charge away from the centre of that opposed conductor spiral produces a magnetic field distribution $B_2(x,y,z)$, such that $B_1(x,y,z)$ and $B_2(x,y,z)$ are substantially similar in the sense that a coupling coefficient "C" defined as $\int\int\int B_1(x,y,z)\cdot B_2(x,y,z)dxdydz$ has the property that $C>0$. Accordingly, the scope of the invention is to be construed in accordance with the substance defined by the following claims.

I claim:

1. An electromagnetic resonator, comprising:

(a) three or more non-intersecting, substantially overlapping surfaces each having a respective physical extent, and each being of approximately similar size and shape separated from one another by a distance which is small in comparison to said physical extent of said surfaces; and, (b) on each of said surfaces, one or more substantially non-intersecting, electrically conductive paths each having a respective width, and each covering substantial portions of said respective surfaces, said path widths being substantially smaller than said physical extent of said surfaces; wherein said conductive paths are oriented such that:

(i) no path on any one of said surfaces is electrically connected to a path on any of said other surfaces;

(ii) for each of said surfaces, macroscopic current flows, with respect to said surfaces, in a direction other that the direction in which microscopic current flows in said paths; and, (iii) said resonator supports at least one mode of electromagnetic oscillation between a first state in which the electromagnetic energy stored by said resonator is substantially electrostatic energy, and a second state in which the electromagnetic energy stored by said resonator is substantially magnetostatic energy, said occillations being at a frequency which is substantially lower than any characteristic self-resonant frequency of electromagnetic oscillation of any one of said paths, taken alone.

2. An electromagnetic resonator as defined in claim 1, wherein said surfaces are configured to have respective radii of curvature, and, for any adjacent first and second pair of said surfaces, said conductive paths comprise first and second electrical conductors which conform, respectively, to said first and second surfaces, said first and second conductors being separated by a distance "t" wherein, over a substantial portion of the region between said first and second surfaces:

(a) $t<<R_1$, where $R_1$ is the radius of curvature of said first surface at a selected point;

(b) $t<<R_2$, where $R_2$ is the radius of curvature of said second surface at a point on said second surface intersected by a sector normal to said first surface at said selected point;

(c) $t>0$;

(d) t is measured along said vector; and, (e) t is much less than said physical extent of said surfaces;

and wherein, if end points of said first conductor are defined as "$a_1$" and "$b_1$" respectively, then analogous end points "$a_2$" and "$b_2$" of said second conductor are defined as those points on said second conductor which, when oppositely charged, and having a continuous charge distribution therebetween, produce an electric field distribution, in regions away from said surfaces, which is more similar to the electric field distribution produced, in regions away from said surfaces, by a charge distribution similarly applied to said first conductor than would be the case if said end points $a_2$ and $b_2$ were interchanged; and wherein:

(i) current flow from $a_1$ to $b_1$ produces a magnetic field distribution $B_1(x,y,z)$; and, (ii) current flow from $b_2$ to $a_2$ produces a magnetic filed distribution $B_2(x,y,z)$;

where $B_1(x,y,z)$ and $B_2(x,y,z)$ are substantially similar, in the sense that a coupling coefficient "C" defined as $C=\int\int\int B_1(x,y,z)\cdot B_2(x,y,z)dxdydz$ has the property that $C>0$.

3. An electromagnetic resonator as defined in claim 1, wherein said conductive paths are further oriented such that, current flow through said paths on one of said surfaces, in a direction which transports charge toward a centre of said one surface, produces a magnetic field distribution $B_1(x,y,z)$, and current flow through said paths on one of said surfaces adjacent to said one surface, in a direction which transports charge away from a centre of said adjacent surface, produces a magnetic field distribution $B_2(x,y,z)$, where $B_1(x,y,z)$ and $B_2(x,y,z)$ are substantially similar in the sense that a coupling coefficient "C" defined as $C=\int\int\int B_1(x,y,z)\cdot B_2(x,y,z)dxdydz$ has the property that $C>0$.

4. An electromagnetic resonator as defined in claim 1, 2 or 3, wherein:

(a) said surfaces are discs; and, (b) said paths are spirals.

5. An electromagnetic resonator as defined in claim 1, 2 or 3, wherein said surfaces separation distance is substantially constant over the regions between said surfaces.

6. An electromagnetic resonator as defined in claim 1, 2 or 3, wherein said paths are formed of superconductor material.

7. An electromagnetic resonator as defined in claim 1, 2 or 3, wherein said paths are formed of thin film, high temperature superconductor material.

8. An electromagnetic resonator as defined in claim 1, further comprising:

(a) a plurality of "n" electrical insulators stacked atop one another;

(b) between each pair of insulators "i" and "i+1", disposed is an electrical conductor spiralling in a first direction, wherein:

(i) i=1, 3, 5, 7, . . . n−2 if "n" is an odd number; and, (ii) i=1, 3, 5, 7, . . . n−1 if "n" is an even number;

(c) between each successive insulator pair "i+1" and "i+2", disposed is an electrical conductor spiralling, in a second direction opposite to said first direction, wherein:

(i) i=1, 3, 5, 7, . . . n−2 if "n" is an odd number; and, (ii) i=1, 3, 5, 7, . . . n−3 if "n" is an even number;

wherein current flow through each of the conductors between each pair of said insulators "i" and "i+1", in a direction which transports charge toward a centre of said conductor spirals, produces a magnetic field distribution $B_1(x,y,z)$, and current flow through each of the conductors between said successive pairs of insulators "i+1" and "i+2", in a direction which transports charge away from the centre of said successive insulator pair conductor spirals, produces a magnetic field distribution $B_2(x,y,z)$, where $B_1(x,y,z)$ and $B_2(x,y,z)$ are substantially similar in the sense that a coupling coefficient "C" defined as C"$\int\int\int B_1(x,y,z)\cdot B_2(x,y,z)dxdydz$ has the property that $C>0$.

9. An electromagnetic resonator as defined in claim 1, further comprising:

(a) an electrical insulator having opposed first and second sides;

(b) a first electrical conductor on said first side, said first conductor spiralling in a first direction;

(c) a second electrical conductor on said second side, said second conductor spiralling in a second direction opposite to said first direction;

wherein current flow through said first conductor, in a direction which transports charge toward a centre of said first conductor spiral, produces a magnetic field distribution $B_1(x,y,z)$, and current flow through said second conductor, in a direction which transports charge away from a centre of said second conductor spiral, produces a magnetic field distribution $B_2(x,y,z)$, where $B_1(x,y,z)$ and $B_2(x,y,z)$ are substantially similar in the sense that a coupling coefficient "C" defined as $C=\int\int\int B_1(x,y,z)\cdot B_2(x,y,z)dxdydz$ has the property that $C>0$.

10. An electromagnetic resonator as defined in claim 1, further comprising a plurality of electrical insulators stacked atop one another, wherein every second one of said insulators comprises:

(a) a first electrical conductor on one side of said one insulator, said first conductor spiralling in a first direction; and, (b) a second electrical conductor on the opposite side of said one insulator, said second conductor spiralling in a second direction opposite to said first direction;

wherein current flow through said first conductor, in a direction which transports charge toward a centre of said first conductor spiral, produces a magnetic field distribution $B_1(x,y,z)$, and current flow through said second conductor, in a direction which transports charge away from a centre of said second conductor spiral, produces a magnetic field distribution $B_2(x,y,z)$, where $B_1(x,y,z)$ and $B_2(x,y,z)$ are substantially similar in the sense that a coupling coefficient "C" defined as $C=\int\int\int B_1(x,y,z)\cdot B_2(x,y,z)dxdydz$ has the property that $C>0$.

11. An electromagnetic resonator as defined in claim 9, 10 or 8, wherein the displacement between opposed sides of each of said insulators is substantially constant.

12. An electromagnetic resonator as defined in claim 9, 10, or 8, wherein said conductors are formed of superconductor material.

13. An electromagnetic resonator as defined in claim 9, 10, or 8, wherein said conductors are formed o f thin film, high temperature superconductor material.

14. An electromagnetic resonator as defined in claim 9, 10 or 8, wherein said insulators have substantially planar opposed surfaces.

15. An electromagnetic resonator as defined in claim 9, 10 or 8, wherein said insulators are discs.

16. An electromagnetic resonator as defined in claim 9, 10 or 8, wherein said conductors respectively cover a substantial portion of the area of said respective sides.

17. An electromagnetic resonator as defined in claim 9, 10 or 8, wherein adjacent insulators are of substantially similar size and shape.

18. An electromagnetic resonator, comprising:

(a) two or more non-intersecting, substantially overlapping surfaces each having a respective physical extent, and each being of approximately similar size and shape and separated from one another by a distance which is small in comparison to said physical extent of said surfaces; and, (b) on each of said surfaces, one or more substantially non-intersecting, electrically conductive paths each having a respective width, and each covering substantial portions of said respective surfaces, said path widths being substantially smaller than said physical extent of said surfaces; wherein said conductive paths are oriented such that:

(i) no path on any one of said surfaces is electrically connected to a path on any of said other surfaces;

(ii) for each of said surfaces, macroscopic current flows, with respect to said surfaces, in a direction other than the direction in which microscopic current flows in said paths; and, (iii) said resonator supports at least one mode of electromagnetic oscillation between a first state in which the electromagnetic energy stored by said resonator is substantially electrostatic energy, and a second state in which the electromagnetic energy stored by said resonator is substantially magnetostatic energy, said oscillations being at a frequency which is substantially lower than any characteristic self-resonant frequency of electromagnetic oscillation of any on e of said paths, taken alone;

wherein said surfaces are spiral rolls.

19. An electromagnetic resonator as defined in claim 18, wherein said paths:

(i) are substantially parallel to one another, when said paths lie on the same surface; and, (ii) overlap one another, when said paths lie on different surfaces immediately adjacent one another.

20. An electromagnetic resonator as defined in claim 18, wherein said paths are formed of superconductor material.

21. An electromagnetic resonator as defined in claim 18, wherein said paths are formed of thin film, high temperature superconductor material.

22. An electromagnetic resonator as defined in claim 18, wherein:

(a) on at least one of said surfaces, at least one of said paths extends around an outer region of said one surface in a spiral fashion, when said one surface is unrolled and laid flat; and, (b) said paths are substantially parallel to one another on another of said surfaces immediately adjacent said one surface.

23. An electromagnetic resonator as defined in claim 18, wherein on one side of each of said surfaces said paths are spirals when said surfaces are unrolled and laid flat; and, on the opposite sides of each of said surfaces said paths are substantially parallel to one another.

24. An electromagnetic resonator, comprising:

(a) two or more non-intersecting, substantially overlapping surfaces each having a respective physical extent, and each being of approximately similar size and shape separated from one another by a distance which is small in comparison to said physical extent of said surfaces; and, (b) on each of said surfaces, one or more substantially non-intersecting, electrically conductive paths each having a respective width, and each covering substantial portions of said respective surfaces, said path widths being substantially smaller than said physical extent of said surfaces; wherein said conductive paths are oriented such that:

(i) no paths on any one of said surfaces is electrically connected to a path on any of said other surfaces;

(ii) for each of said surfaces, macroscopic current flow, with respect to said surfaces, in a direction other than the direction in which microscopic current flows in said paths; and, (iii) said resonator supports at least one mode of electromagnetic oscillation between a first state in which the electromagnetic energy stored by said resonator is substantially electrostatic energy, and a second state in which the electromagnetic energy stored by said resonator is substantially magnetostatic energy, said oscillations being at a frequency which is substantially lower than any characteristic self-resonant frequency of electromagnetic oscillation of any one of said paths, taken alone;

wherein said surfaces are spiral rolls and said paths are spirals when said surfaces are unrolled and laid flat.

25. An electromagnetic resonator as defined in claim 24, wherein said surfaces are spiral rolls and said paths are formed of thin film, high temperature superconductor material.

26. An electromagnetic resonator as defined in claim 24, wherein:

(a) said surfaced are spiral rolls; and, (b) on each of said surfaces, said paths are substantially parallel to one another.

* * * * *